United States Patent [19]

Knollmueller

[11] 4,132,664

[45] * Jan. 2, 1979

[54] FUNCTIONAL FLUID METHOD USING ALKOXYSILANE MULTIPLE CLUSTER COMPOUNDS

[75] Inventor: Karl O. Knollmueller, Hamden, Conn.

[73] Assignee: Olin Corporation, New Haven, Conn.

[ * ] Notice: The portion of the term of this patent subsequent to Nov. 16, 1993, has been disclaimed.

[21] Appl. No.: 798,970

[22] Filed: May 20, 1977

[51] Int. Cl.[2] ..... C10M 3/46; C10M 3/44

[52] U.S. Cl. ..... 252/78.3; 260/448.8 A

[58] Field of Search ..... 252/78.3; 260/448.8 A

[56] References Cited

U.S. PATENT DOCUMENTS 3,992,429 11/1976 Knollmueller ..... 252/78.3 X

*Primary Examiner*—Harris A. Pitlick

*Attorney, Agent, or Firm*—Robert J. Feltovic; Thomas P. O'Day

[57] ABSTRACT

Methods are described wherein a functional fluid is used as a medium for the transmission of pressure or heat. The functional fluid used is a composition containing an effective amount of an alkoxysilane multiple cluster compound.

18 Claims, No Drawings

FUNCTIONAL FLUID METHOD USING ALKOXYSILANE MULTIPLE CLUSTER COMPOUNDS

BACKGROUND OF THE INVENTION

Silicate esters, silanes, silanols, oxysilanes and oxysilanols are well known in the art for their utility as functional fluids. Many of these compounds previously have been proposed for use as heat transfer fluids, hydraulic fluids, brake fluids, transmission fluids and the like.

The specific alkoxysilane multiple cluster compounds used in the functional fluid methods of the present invention are disclosed in the present inventor's U.S. Pat. No. 3,992,429.

DETAILED DESCRIPTION OF THE PREFERRED EMBODIMENTS

The present invention is directed to methods wherein a functional fluid is used as a medium for the transmission of pressure or heat. The specific functional fluid utilized is a composition containing an effective amount of an alkoxysilane multiple cluster compound of the general formulas:

(I)

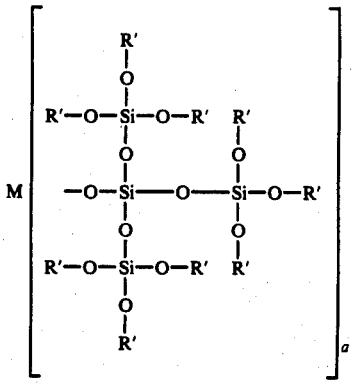

and (II)

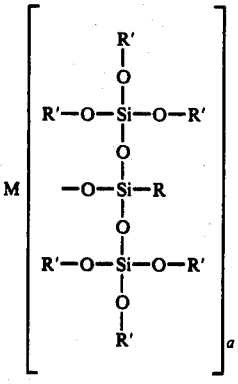

wherein a = 2, 3 or 4; M is a substituted or unsubstituted branched or straight chain hydrocarbon di-, tri-, or tetraradical having up to 25 carbon atoms; R is hydrogen, an alkyl, alkenyl, aryl or aralkyl groups and each R′ is independently selected from the same group as R with the proviso that at least a majority of R′ radicals are sterically hindered alkyl groups having at least 3 carbon atoms.

The above Formulas (I) and (II) may be written in abbreviated form as follows:

$$M\{OSi[OSi(OR')_3]_3\}_a \quad \text{(III)}$$

and $$M\{OSiR[OSi(OR')_3]_2\}_a \quad \text{(IV)}$$

wherein the variables are defined above.

The compounds of the present invention are those represented by the above formulas wherein a = 2, 3 or 4, as mentioned. Desirably, a = 2 or 3 and preferably a = 2. The substituent M is defined as a substituted or unsubstituted hydrocarbon radical, either branched or straight chained and branched radicals are preferred. By hydrocarbon radical is meant both oxylated radicals and radicals which have not been oxylated. Thus, M may be a straight or branched chain hydrocarbon diradical, triradical, or tetraradical containing carbon and hydrogen atoms, with or without inert substituents. Alternatively, M may be a straight or branched chain hydrocarbon diradical, triradical or tetraradical having one or more ether and/or ester units, with or without inert substituents. The radical M is a hydrocarbon radical, as defined, having up to about 25 carbon atoms, desirably having about 2 to about 18 carbon atoms, and preferably having about 4 to about 12 carbon atoms. The hydrocarbon radical may, as mentioned, be unsubstituted or it may be substituted and these substituents include, e.g., hydroxy groups, phenyl groups and any substituents which do not interfere with the hydrolytic stability of the molecule to an undesirable degree.

R is defined as hydrogen, an alkyl, alkenyl, or aryl or aralkyl radical. Desirably, R is hydrogen, an alkyl or alkenyl having about 1 to about 18 carbon atoms or an aryl or aralkyl having about 6 to about 24 carbon atoms. Preferably, R is hydrogen, an alkyl having about 1 to about 8 carbon atoms or an aryl or aralkyl having about 6 to about 14 carbon atoms. In the above formulas, each R′ is independently selected from the same group as R, with the proviso that at least a majority of the R′ radicals are sterically hindered alkyl groups having at least 3 carbon atoms. The desired and preferred groups for R′ are the same as for R subject to the preceding proviso. Desirably, at least a majority of the R′ radicals are sterically hindered alkyl groups having about 3 to about 24 carbon atoms and preferably are sterically hindered alkyl groups having about 4 to about 12 carbon atoms. By sterically hindered alkyl groups is meant alkyl radicals which contribute to the hydrolytic stability of the molecule, i.e., which inhibit the reaction of water with the silicon-oxygen or the carbon-oxygen bonds in the molecule. Exemplary of sterically hindered alkyl radicals are non-linear primary alkyl radicals having a beta position side chain of at least 2 carbon atoms, secondary alkyl radicals and tertiary alkyl radicals. Particularly useful sterically hindered alkyl groups include sec. butyl, isobutyl, 2-ethyl butyl, 2-ethyl pentyl, 3-ethyl pentyl, 2-ethyl hexyl, 3-ethyl hexyl, and 2,4-dimethyl-3-pentyl, etc.

In the method of preparing these alkoxysilane cluster compounds a halogenated oxysilane compound is reacted with a polyol in the presence of a hydrogen halide acceptor base, and optionally a solvent, to obtain a cluster compound-containing product. Preparation of these compounds used in the methods of the present invention is described in detail in the present inventor's U.S. Pat. No. 3,992,429 which is hereby incorporated in its entirety by reference.

The functional fluid method to which the present invention is directed includes hydraulic-type functional fluid methods and heat transfer-type functional fluid methods.

The hydraulic-type fluid methods include any method wherein a mechanical effort is converted to pressure at a first location, the pressure is transmitted from this first location to a second location via a hydraulic fluid, and the pressure in converted to a second mechanical effort at the second location. Thus, the hydraulic methods contemplated by the present invention include hydraulic brake systems, hydraulic steering mechanisms, hydraulic transmissions, hydraulic jacks and hydraulic lifts. Included among these are the hydraulic systems used in heavy equipment and transportation vehicles including highway and construction equipment, railways, planes, and aquatic vehicles. Also included are special or custom fluid-repairing methods such as high pressure or temperature gradient systems including those employed in arctic environments as well as those found in aerospace and lunar vehicles and the like.

The heat transfer-type fluid methods include the hydraulic methods described above wherein heat is dissipated by the hydraulic fluid and include many other systems as well. In general, the present invention contemplates heat transfer methods wherein heat is passed from a first heat conductor at a first location to a heat transfer fluid, the heat is transmitted from the first location to a second location via the heat transfer fluid, and the heat is passed from the heat transfer fluid to a second conductor at the second location. Thus, the heat transfer methods of the present invention include heat dissipation systems, fluidic heating systems, e.g., radiator-type circulating fluid heating systems, heat exchange system such as gas-liquid and liquid-liquid concurrent and countercurrent tubular heat exchangers as are used, for example, in the chemical process industries, cooling systems for nuclear reactors, radiator-type cooling systems, and any other temperature gradient systems in which a closed or sealed fluid heat transfer medium is used.

In the functional fluid methods of the present invention, the compounds of Formula I above are used in an effective amount. Due to the particularly advantageous hydrolytic stability of these compounds, as well as their high lubricity and low viscosity indices, the compounds may be used without any additives or diluents. Thus, by an effective amount of these compounds is meant the compound product without additional components as well as fluids containing additional fluid components. In one embodiment, the compounds of Formula I may be employed without additives or diluents. Alternatively, these compounds may comprise the base component of a functional fluid or may constitute a minor component, e.g., an additive, in a functional fluid containing a different base component. In general, an effective amount may be any amount which will produce the desired fluid characteristics for a given system. Therefore, as little as 5% or less of one or more of the compounds of Formula I may be used or as much as about 100% of the compounds may be used, percentages by weight. For example, 20 to about 95% or about 100% of the functional fluid may be one or more of the compounds of Formula I, e.g., 45 to 90% of the fluid may comprise one or more compound of Formula I.

Various diluents, inhibitors and other additives are well known in the functional fluid art and these may optionally be added to the functional fluids used in the systems of the present invention, if desired. For example, a diluent component may be one or more glycol monoethers or diethers of the formula:

$$R_1[O-R_2]_xOR_3 \qquad (V)$$

wherein $R_1$ is an alkyl of 1 to 4 carbon atoms; $R_2$ is alkylene of 2 to 4 carbon atoms; $R_3$ is hydrogen or an alkyl of 1 to 4 carbon atoms; and x is an integer from 2 to 4. The $R_1$, $R_2$ and $R_3$ groups may be straight chained or branched and the alkylene oxide group $OR_3$ in the above formula may comprise mixtures of alkylene oxides. Also included among the possible diluents are one or more glycols, such as the alkylene glycols, having the formula:

$$HO(R_4O)_yH \qquad (VI)$$

wherein $R_4$ is an alkylene of 2 to 3 carbon atoms and y is an integer from 1 to 5.

Illustrative of the above-described diluents are the following: diethylene glycol monoethyl ether, diethylene glycol monobutyl ether, triethylene glycol monomethyl ether, triethylene glycol monoethyl ether, tetraethylene glycol monomethyl ether, ethylene glycol, propylene glycol, diethylene glycol and tetraethylene glycol. Various other diluents and mixtures thereof, which are well known in the art may also be used with the organosilane containing base component of this invention. U.S. Pat. No. 3,377,288 discloses various diluents which may be utilized.

Generally, the particular amount of diluents which is used is not critical and widely varying amounts may be used. More particularly, the diluent components may constitute from 0 up to about 80% by weight of the fluid and preferably from about 20 to about 60%.

Various additives may be added to the fluids used in the methods of this invention to control or modify various chemical and physical properties. Among the various types of additives which can be added to the fluids are included inhibitors for pH and corrosion control, antioxidants, rush inhibitors, viscosity index improvers, pour point depressants, lubricating additives, antifoamants, stabilizers, vapor phase corrosion inhibitors, rubber swelling adjusters, demulsifiers, dyes and odor suppressants. Generally, the total amount of additives which may be incorporated into the fluid composition will vary between about 0 to about 20%, e.g., from about 0.1 to 8% and more specifically from about 0.2 to about 5% by weight, based on the total weight of the fluid composition.

For example, alkaline inhibitors for pH and corrosion control may optionally be employed in an amount sufficient to maintain alkaline conditions in the fluid compositions, e.g., at an apparent pH value of from about 7 to about 11.5, if desired. These inhibitors may generally be added in an amount of from about 0 to about 8% by weight based on the the total weight of fluid compositions, e.g., from about 0.5 to about 6%. Useful alkaline inhibitors include, for example, alkali metal salts of higher fatty acids such as potassium oleate, the potassium soap of rosin or tall oil fatty acids, amines such as morpholine and ethanolamine and amine salts such as mono- or dibutyl ammonium borates.

An antioxidant may optionally be used, if desired. Typical antioxidants include, 2,2,-di(4-hydroxyphenyl) propane, phenothiazine, amines such as phenyl-alpha-naphthylamine and hindered phenols such as dibutyl cresol. Generally, the amount of antioxidant used will vary from 0 to about 3% by weight, e.g., from about 0.001 to about 2% by weight based on the total weight of the fluid composition.

Additionally, other additives, if desired, may be incorporated into the fluid composition. For example, corrosion inhibitors such as butynediol and rubber swelling adjusters such as dodecyl benzene may be used.

The above-noted inhibitors and additives are merely exemplary and are not intended as an exclusive listing of the many well-known materials which can be added to fluid compositions to obtain various desired properties. Other illustrations of additives and diluents which may be used can be found in U.S. Pat. No. 3,377,288 and in "Introduction to Hydraulic Fluids" by Roger E. Hatton, Reinhold Publishing Corp. (1962).

The following examples depict various embodiments of the present invention; they are intended to be illustrative and not limiting in nature. All parts and percentages are by weight unless otherwise specified.

PREPARATION OF ALKOXYSILANE MULTIPLE CLUSTER COMPOUND SAMPLES

Sample I

A 1 liter three-neck flask, equipped with a stirrer, thermometer, reflux condenser and an equilibrated dropping funnel is charged with 139 g $$[(\text{sec. } C_4H_9O)_3SiO]_2\underset{\underset{Cl}{|}}{Si}-CH_3$$

0.23 mole in 380 ml benzene. The dropping funnel is charged with a solution of 7.13 g ethylene glycol (0.115 mole) 29.3 g pyridine (0.37 mole) and 35 ml benzene. The addition is carried out at ~30° C., without external cooling the temperature rises to ~40° C. The stirred mixture is subsequently heated to 75°-80° C. for 12 hours. The pyridine hydrochloride is subsequently filtered off whereby 90-98% of the theory is recovered. The rest is removed by washing the benzene solution with water by stirring with 100 ml water for 30 minutes. The organic phase is separated from the water in a separatory funnel, washed $Cl^-$ free and is then dried over $CaCl_2$ or $MgSO_4$. After vacuum stripping of the solvent, ~134 g crude product is obtained. The crude product is fractionated in fractionation apparatus with a Vigreux column, which is heated to prevent heat losses at the high distillation temperatures encountered.

After a forerun of products of incomplete addition b.p. 140°-248°/0.01, the product is obtained boiling at 248°± 2° C./0.01 mm in 77.3% yield.

$n_D^{25} = 1.4175$

Calculated for $Si_6C_{52}H_{118}O_{18}$: Si=14.04%; C=52.05%; H=9.91%. Found: Si=14.11%; C=52.02%; H=9.87%.

Sample II

Using equipment and procedure as for Sample I, but reacting 52.05 g ClSi $[(\text{sec. } C_4H_9O)_3SiO]_3$ = 0.061 mole in 100 ml benzene with a mixture of 1.89 g ethylene glycol 0.035 mole and 10 g pyridine = 0.126 mole affords after the washing and topping off volatile by-products boiling up to 280° C./9 × $10^{-3}$ mm Hg, 15.75 g clear product with the following analytical data:

Calculated for $Si_8C_{74}H_{166}O_{26}$: Si=13.24%; C=52.38%; H=9.86%. Found: Si=14.1%; C=51.98%; H=9.72%.

The fraction boiling at 280°/9 × $10^{-3}$ mm analyzes as follows:

(3.55 grams) Si=13.5% C=52.28% H=9.52%.

Total yield 37.4%.

Sample III

Following the procedure as for Sample I, 125 g ClSi $[(\text{sec. } C_4H_9O)_3SiO]_2$, 0.207 mole in 300 ml benzene is reacted with 13.15 g 2 ethyl-1,3 hexane diol (0.103 mole), and 17.65 g pyridine (0.223 mole). After heating for 12 hours to 60-70° C. and the usual work-up there is obtained 17.4 g of $$\left\{(\text{sec. } C_4H_9O)_3SiO]_2\overset{\overset{CH_3}{|}}{Si}\right\}_2(OCH_2\overset{\overset{CH_3}{|}}{\underset{\underset{C_2H_5}{|}}{C}}-\overset{\overset{CH_3}{|}}{\underset{\underset{C_3H_7}{|}}{C}}-O)$$

b.p. 256°-260°/$10^{-2}$ mm $n_D^{25}$ = 1.4254

Analysis: Calculated for $Si_6C_{58}H_{130}O_{18}$: Si=13.23%; C=54.25%; H=10.20%. Found: Si=13.24%; C=54.11%; H=10.09%.

Sample IV

Following the procedure outlined for Sample I, 123.3 g $$[(\text{sec. } C_4H_9O)_3SiO]_2\underset{\underset{Cl}{|}}{Si}CH_3$$

(0.024 mole) in 300 ml benzene is reacted with 10.61 g neopentyl glycol (0.102 mole) and 21 g pyridine (0.265 mole) in 80 ml benzene at 20° C. After heating to 80° C. for 12 hours and the usual work-up, there is obtained: 72.2 g $$\left\{[(\text{sec. } C_4H_9O)_3SiO]_2\overset{\overset{CH_3}{|}}{Si}\right\}_2(OCH_2)_2C(CH_3)_2$$

57% yield b.p. 260-265/~5 × $10^{-3}$ mm $n_D^{25}$ = 1.4198

Calculated C = 53.18%; Found 53.39% MW 1200 (by VPO).

Calculated H = 10.06%; Found 10.06% Calc. 1242.

Calculated Si = 13.57%; Found 13.53%.

SAMPLE V

Reacting 96.24 g $$[(\text{sec. } C_4H_9O)_3SiO]_2\underset{\underset{Cl}{|}}{Si}C_6H_5$$

(0.144 mole) with 7.51 g neopentyl glycol (0.072 mole) and 18.04 g pyridine (0.23 mole) in a total of 360 ml benzene affords 65.4 g $(C_6H_5Si\ [(sec.\ C_4H_9O)_3SiO]_2)_2(OCH_2)_2C(CH_3)_2$ b.p. 272–275° /3 × $10^{-2}$ mm Hg $n_D^{25}$ = 1.4451; Yield 66.4%

Analysis:

C Calculated=57.14%; Found 58.5% MW 1300 (by VPO).

H Calculated=9.45%; Found 9.33% Calc. 1366.

Si Calculated=12.33%; Found 12.11%.

SAMPLE VI

Reaction of $$\begin{array}{l} H_3CSi[(sec.\ C_4H_9O)_3SiO]_2 \\ \quad\ \ |\ \ \ \

-continued

FUNCTIONAL FLUID PROPERTIES

| Sample No. | | Pour Point ° F. | Viscosity 100° F. | Viscosity 210° F. | (4 Ball, 1800 CS KPM 1 hr., 40 kg, 167° F.) Wear Scar mm Loss | Weight Flash 400° F. % | Stability Point ° F. | Hydrolytic % Solids Formed |
|---|---|---|---|---|---|---|---|---|
| 4 | $\left\{[(\text{sec. } C_4H_9O)_3SiO]_2\overset{CH_3}{\overset{\vert}{Si}}\right\}_2(OCH_2\overset{CH_3}{\overset{\vert}{\underset{CH_3}{\underset{\vert}{C}}}}-CH_2O)$ | <−40 | 39.35 | 10.95 | 0.58 | 3.45 | 415 | 0.012 |
| | | | $VI_e$ | 300 | | | | |
| 5 | $\left\{\text{C}_6\text{H}_5\text{Si}([OSi(\text{sec. } C_4H_9O)_3])_2\right\}(OCH_2\overset{CH_3}{\overset{\vert}{\underset{CH_3}{\underset{\vert}{C}}}}-CH_2O)$ | <−40 | 134.8 | 29.12 | 1.06 | 1.76 | 425 | 0.007 |
| | | | $VI_e$ | 266 | | | | |
| 6a | $CH_3-CH_2$ / $HO-CH_2-C\{(CH_2OSi[OSi(\text{sec. } C_4H_9O)_3]\}_2$ | <−40 | 38.49 | 9.88 | 0.59 | 5.69 | 280 | — |
| | | | $VI_e$ | 272 | | | | |
| 6b | $CH_3CH_2C\{CH_2OSi[OSi(\text{sec. } C_4H_9O)_3]_2CH_3\}_3$ | <−40 | 168.69 | 36.61 | 0.6 | 2.76 | 430 | 0.07 |
| | | | $VI_e$ | 275 | | | | |
| 7 | $HOCH_2C\{CH_2OSi[OSi(\text{sec. } C_4H_9O)_3]_2CH_3\}_3$ | <−40 | 157.68 | 34.65 | 0.56 | 3.98 | 420 | 0.02 |
| | | | $VI_e$ | 275 | | | | |

$VI_e$ Extended Viscosity Index ASTM D 22 70

I claim:

1. In a functional field method comprising converting a first mechanical effort to pressure at a first location, transmitting said pressure from said first location to a second location through use of a hydraulic fluid, and converting said pressure at said second location to a second mechanical effort, the improvement characterized by using as said hydraulic fluid a composition comprising an effective amount of a compound having the formula selected from:

(I)

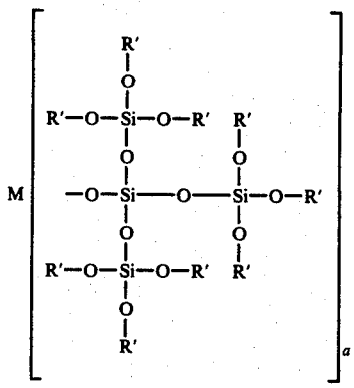

and (II)

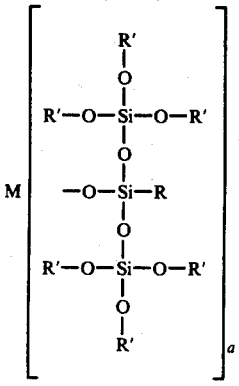

wherein a = 2, 3 or 4; M is a substituted or unsubstituted branched or straight chain hydrocarbon radical; R is hydrogen, an alkyl, alkenyl, aryl or aralkyl group and each R′ is independently selected from the same group as R with the proviso that at least a majority of R′ radicals are sterically hindered alkyl groups having at least 3 carbon atoms.

2. The method of claim 1 wherein M is a substituted or unsubstituted branched or straight chain hydrocarbon radical which has been oxylated; R is hydrogen, an alkyl or alkenyl having about 1 to about 18 carbon atoms or an aryl or aralkyl having about 6 to about 24 carbon atoms, and each R′ is independently selected from the same group as R, subject to the above proviso.

3. The method of claim 2 wherein a majority of the R′ radicals are sterically hindered alkyl groups having about 3 to about 24 carbon atoms.

4. The method of claim 1 wherein a = 2 or 3; M has about 2 to about 18 carbon atoms; R is hydrogen, an alkyl having about 1 to about 8 carbon atoms, or an aryl or aralkyl having about 6 to about 14 carbon atoms, and each R′ is independently selected from the same group as R, subject to the above proviso.

5. The method of claim 4 wherein M has about 4 to about 12 carbon atoms and a majority of the R′ radicals are sterically hindered alkyl groups having about 4 to about 12 carbon atoms.

6. The method of claim 1 wherein a = 2 or 3; M has about 2 to about 18 carbon atoms and a majority of the R′ radicals are sterically hindered alkyl groups having about 3 to about 24 carbon atoms.

7. The method of claim 6 wherein a = 2; M has about 4 to about 12 carbon atoms and the R′ radicals are sterically hindered alkyl groups having about 4 to about 12 carbon atoms.

8. The method of claim 1 wherein the compound is represented by the Formula (I).

9. The method of claim 1 wherein the compound is represented by the Formula (II).

10. In a functional fluid method comprising passing heat from a first heat conductor to a heat transfer fluid at a first location, transmitting the heat from said first location to a second location through use of said heat transfer fluid, the improvement characterized by using a heat transfer fluid comprising an effective amount of a compound having the formula selected from:

(I)

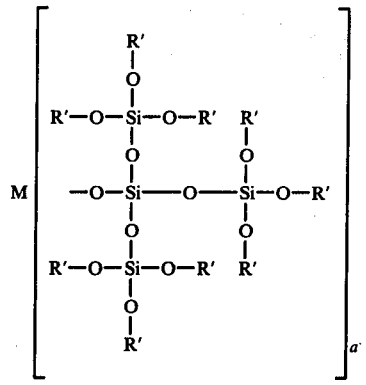

and (II)

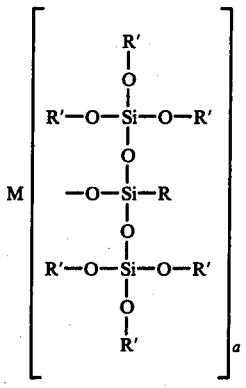

wherein a = 2, 3 or 4; M is a substituted or unsubstituted branched or straight chain hydrocarbon radical; R is hydrogen, an alkyl, alkenyl, aryl or aralkyl group and each R′ is independently selected from the same group as R with the proviso that at least a majority of R′ radicals are sterically hindered alkyl groups having at least 3 carbon atoms.

11. The method of claim 10 wherein M is a substituted or unsubstituted branched or straight chain hydrocarbon radical which has been oxylated; R is hydrogen, an alkyl or alkenyl having about 1 to about 18 carbon atoms or an aryl or aralkyl having about 6 to about 24 carbon atoms, and each R′ is independently selected from the same group as R, subject to the above proviso.

12. The method of claim 11 wherein a majority of the R′ radicals are sterically hindered alkyl groups having about 3 to about 24 carbon atoms.

13. The method of claim 10 wherein a = 2 or 3; M has about 2 to about 18 carbon atoms; R is hydrogen, an alkyl having about 1 to about 8 carbon atoms, or an aryl or aralkyl having about 6 to about 14 carbon atoms, and each R′ is independently selected from the same group as R, subject to the above proviso.

14. The method of claim 13 wherein M has about 4 to about 12 carbon atoms and a majority of the R′ radicals are sterically hindered alkyl groups having about 4 to about 12 carbon atoms.

15. The method of claim 10 wherein a = 2 or 3; M has about 2 to about 18 carbon atoms and a majority of the R′ radicals are sterically hindered alkyl groups having about 3 to about 24 carbon atoms.

16. The method of claim 15 wherein a = 2; M has about 4 to about 12 carbon atoms and the R′ radicals are sterically hindered alkyl groups having about 4 to about 12 carbon atoms.

17. The method of claim 10 wherein the compound is represented by the Formula (I).

18. The method of claim 10 wherein the compound is represented by the Formula (II).

* * * * *